US010139763B2

(12) United States Patent
Yamada et al.

(10) Patent No.: US 10,139,763 B2
(45) Date of Patent: Nov. 27, 2018

(54) IMAGE FORMATION DEVICE WITH LIFE DETERMINATION SECTION FOR REPLACEABLE UNIT

(71) Applicant: Konica Minolta, Inc., Tokyo (JP)

(72) Inventors: Tatsutoshi Yamada, Toyokawa (JP); Kazuya Kitamura, Nagoya (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/619,838

(22) Filed: Jun. 12, 2017

(65) Prior Publication Data

US 2018/0004139 A1 Jan. 4, 2018

(30) Foreign Application Priority Data

Jun. 29, 2016 (JP) ..... 2016-129066

(51) Int. Cl.
*G03G 15/00* (2006.01)
*G03G 15/01* (2006.01)
(Continued)

(52) U.S. Cl.
CPC ..... *G03G 15/5041* (2013.01); *G03G 15/0152* (2013.01); *G03G 15/5058* (2013.01); *G03G 15/5062* (2013.01); *G03G 15/55* (2013.01); *G03G 21/20* (2013.01); *G03G 15/043* (2013.01); *G03G 15/065* (2013.01);
(Continued)

(58) Field of Classification Search
CPC ... G03G 15/065; G03G 15/5041; G03G 15/55
See application file for complete search history.

(56) References Cited

U.S. PATENT DOCUMENTS 6,151,460 A 11/2000 Sawaki
2006/0152775 A1 7/2006 Itoyama et al.
(Continued)

FOREIGN PATENT DOCUMENTS

EP 1434106 A2 6/2004
JP H10-097110 A 4/1998
JP 2012141369 A 7/2012

OTHER PUBLICATIONS

Extended European Search Report dated Feb. 7, 2018 from the corresponding European Application No. 17175181.1.

*Primary Examiner* — Sandra Brase
(74) *Attorney, Agent, or Firm* — Lucas & Mercanti, LLP

(57) ABSTRACT

Provided is an image formation device including a photoreceptor configured to carry a toner image and a developer configured to form the toner image on a surface of the photoreceptor and configured such that the developer is a replaceable development unit, the image formation device including: a development bias application section configured to apply a development bias to between the photoreceptor and the developer; a stabilization control section configured to perform image stabilization control of determining a development bias value to be used in future by changing the development bias while measuring a density of the toner image formed by the developer, thereby obtaining the toner image with a target density; and a life determination section configured to determine expiration of use of the development unit when the development bias value determined by the stabilization control falls outside a preset acceptable range.

12 Claims, 14 Drawing Sheets

(51) Int. Cl.
*G03G 21/20* (2006.01)
*G03G 15/06* (2006.01)
*G03G 15/043* (2006.01)

(52) U.S. Cl.
CPC ..... *G03G 2215/00569* (2013.01); *G03G 2215/0164* (2013.01); *G03G 2221/1624* (2013.01)

(56) References Cited

U.S. PATENT DOCUMENTS

2010/0166440 A1* 7/2010 Nishimura ..... G03G 15/065 399/29
2016/0124367 A1* 5/2016 Kaneko ..... G03G 15/065 399/53

* cited by examiner

FIG. 10

| | Y | | M | | C | | K | |
|---|---|---|---|---|---|---|---|---|
| DEVELOPMENT BIAS | LESS THAN 300krot | EQUAL TO OR GREATER THAN 300krot | LESS THAN 300krot | EQUAL TO OR GREATER THAN 300krot | LESS THAN 300krot | EQUAL TO OR GREATER THAN 300krot | LESS THAN 300krot | EQUAL TO OR GREATER THAN 300krot |
| UPPER LIMIT THRESHOLD | 500 | 400 | 460 | 400 | 460 | 400 | 520 | 430 |
| LOWER LIMIT THRESHOLD | 390 | 260 | 390 | 270 | 340 | 250 | 410 | 330 |

IMAGE FORMATION DEVICE WITH LIFE DETERMINATION SECTION FOR REPLACEABLE UNIT

The entire disclosure of Japanese Patent Application No. 2016-129066 filed on Jun. 29, 2016 including description, claims, drawings, and abstract are incorporated herein by reference in its entirety.

BACKGROUND OF THE INVENTION

Field of the Invention

The present invention relates to an image formation device configured to form an image using toner. More specifically, the present invention relates to an image formation device including a developer as a replaceable development unit and configured to manage the life of the development unit. Alternatively, the present invention relates to an image formation device including a photoreceptor as a replaceable photoreceptor unit and configured to manage the life of the photoreceptor unit.

Description of the Related Art

A device described in JP 2012-141369 A can be described as an example of the typical image formation device of this type. In the image formation device described in JP 2012-141369 A, an extension can be set for the life of a consumable. When no extension is set, the life is determined using a "first life value." When the extension is set, the life is determined using an "extension life value" different from the "first life value." This allows proper image formation operation.

However, in the technique of JP 2012-141369 A, two types of life values are used differently depending on the presence or absence of extension setting, but these values are merely for the same indicator. For this reason, the following problem is caused when the consumable is a development unit and the indicator for the life value is, e.g., the cumulative number of printed sheets. The life value of the development unit is set such that an image quality is not lowered due to progression in deterioration of a component of the development unit.

Meanwhile, lowering of the image quality due to development depends, under present circumstances, not only on deterioration of the development unit but also on the progress status of deterioration of a photoreceptor. For this reason, the life value of the development unit needs to be set such that lowering of the image quality does not appear regardless of the degree of deterioration of the photoreceptor, considering safety. The same applies to the "extension life value" of JP 2012-141369 A. Thus, depending on the degree of deterioration of the photoreceptor, it might be conversely determined as expiration of the life early before the potential life of the development unit is used up.

Moreover, there is also a problem when the consumable is the photoreceptor unit and the indicator for the life value is, e.g., a cumulative use amount of the photoreceptor. This is because of the following reason. The photoreceptor comes to the end of the life due to a decrease in the film thickness of a photosensitive layer on a surface of the photoreceptor. However, such a film thickness decrease is not always accurately proportional to the cumulative use amount such as the cumulative number of rotations. This is because of, e.g., an individual difference in the photoreceptor itself, an environment factor in execution of image formation, and an individual difference in a peripheral member such as a charging member.

SUMMARY OF THE INVENTION

The present invention has been made to solve the problems of the typical technique described above. That is, an object of the present invention is to provide an image formation device in which life determination is performed according to a relationship between a development unit and a photoreceptor so that life expiration can be determined after the potential life of the development unit has been used up. Alternatively, another object of the present invention is to provide an image formation device in which life management is performed based on a parameter directly linked to the film thickness of the photoreceptor so that life expiration can be determined after the potential life of the photoreceptor unit has been used up.

To achieve at least one of the abovementioned objects, according to an aspect, there is provided an image formation device including a photoreceptor configured to carry a toner image and a developer configured to form the toner image on a surface of the photoreceptor and configured such that the developer is a replaceable development unit, and the image formation device reflecting one aspect of the present invention comprises: a development bias application section configured to apply a development bias to between the photoreceptor and the developer; a stabilization control section configured to perform image stabilization control of determining a development bias value to be used in future by changing the development bias while measuring a density of the toner image formed by the developer, thereby obtaining the toner image with a target density; and a life determination section configured to determine expiration of use of the development unit when the development bias value determined by the stabilization control falls outside a preset acceptable range.

In the image formation device according to the aspect, the image stabilization control is performed. That is, the development bias value to be used in future is determined by changing the development bias while measuring the density of the toner image formed by the developer, and as a result, the toner image with the target density is obtained. With this development bias value, the life of the development unit is determined. The development bias value reflects, to some extent, not only the status of deterioration of the development unit, but also the progress status of deterioration of the photoreceptor. This allows determination of such a life that the development unit is replaced after the potential life thereof has been effectively used up.

In the image formation device according to any of the aspects, the image formation device preferably further comprises: a photoreceptor use amount counting section configured to count a cumulative use amount of the photoreceptor, wherein the acceptable range used by the life determination section is preferably set to shift downward in a case of a great cumulative use amount of the photoreceptor as compared to a case of a small cumulative use amount of the photoreceptor. With this configuration, the life of the development unit is also favorably determined according to the status of deterioration of the photoreceptor. Note that the cumulative use amount of the photoreceptor is preferably a cumulative rotation time, the cumulative number of rotations, or the number of printed sheets.

In the image formation device according to any of the aspects, the developer preferably includes a plurality of developers, the developers are preferably individual replaceable development units, and the acceptable range used by the life determination section is preferably set for each development unit. With this configuration, optimal life determination for each development unit can be performed.

In the image formation device according to any of the aspects, the image formation device preferably further comprises: an environment condition storage section configured to store an environment condition when the image stabilization control is performed, wherein the life determination section is preferably configured such that only a development bias value determined under a preset environment condition is available for determination. This is because accuracy lowering due to use of a development bias value determined under extreme environment can be prevented.

In the image formation device according to any of the aspects, the image formation device preferably further comprises: a development use amount counting section configured to count a cumulative use amount of the development unit, wherein the life determination section is preferably configured not to perform determination until the cumulative use amount of the development unit reaches a preset defined amount, to perform the determination after the cumulative use amount of the development unit has reached the defined amount, and such that only the determined development bias value is available for the determination after the cumulative use amount of the development unit has reached the defined amount. This is because it is not necessary to perform life determination while the development unit is relatively new. Moreover, this is because the newly-determined development bias value is more advantageous in terms of life determination accuracy. The cumulative use amount of the development unit is preferably the cumulative rotation time or the cumulative number of rotations of a development roller, or preferably the number of printed sheets.

In the image formation device having a photoreceptor use amount counting section according to any of the aspects, the photoreceptor is preferably a photoreceptor unit replaceable independently of replacement of the development unit. In this case, the photoreceptor use amount counting section counts the cumulative use amount for the currently-attached photoreceptor unit, and therefore, the life of the development unit can be more properly performed.

To achieve at least one of the abovementioned objects, according to an aspect, there is provided an image formation device including a photoreceptor configured to carry a toner image, a charging member configured to charge a surface of the photoreceptor, an exposure section configured to write an electrostatic latent image onto the charged surface of the photoreceptor, and a developer configured to form the toner image on the electrostatic latent image on the photoreceptor, and configured such that the photoreceptor is a replaceable photoreceptor unit, and the image formation device reflecting one aspect of the present invention comprises: a photoreceptor use amount counting section configured to count a cumulative use amount of the photoreceptor unit; a charging bias application section configured to apply a charging bias to between the photoreceptor and the charging member and to measure, in other states than image formation, a charging current flowing between the photoreceptor and the charging member in a state in which the charging bias is applied to between the photoreceptor and the charging member; a film thickness decrease calculation section configured to calculate a decreasing gradient of a film thickness of the photoreceptor unit based on the measured charging current and the cumulative use amount of the photoreceptor unit in measurement; a film thickness decreasing gradient holding section configured to hold the film thickness decreasing gradient of the photoreceptor unit and to newly hold, when a film thickness decreasing gradient is newly calculated, a representative value of the previously-held film thickness decreasing gradient and the newly-calculated film thickness decreasing gradient; and a photoreceptor life management section configured to obtain a consumption rate of the photoreceptor based on the cumulative use amount of the photoreceptor unit and the film thickness decreasing gradient held by the film thickness decreasing gradient holding section at time of execution of the image formation.

In the image formation device according to another aspect described above, the charging current is measured in other states than image formation. Then, the film thickness decreasing gradient is calculated based on the measured charging current and the cumulative use amount of the photoreceptor unit. The consumption rate of the photoreceptor is obtained based on such a film thickness decreasing gradient, and the life of the photoreceptor is managed. The charging current reflects the status of each image formation device, and therefore, the life of the photoreceptor unit can be favorably managed. Further, the film thickness decreasing gradient is updated by the representative value weighting the newly-calculated film thickness decreasing gradient every time the film thickness decreasing gradient is newly calculated. Thus, life management is performed with a higher accuracy. Needless to say, the cumulative use amount of the photoreceptor is preferably a cumulative rotation time, the cumulative number of rotations, or the number of printed sheets.

In the image formation device according to another aspect described above, the film thickness decreasing gradient holding section is preferably configured to use, as the film thickness decreasing gradient, a fixed value prepared in advance in early phase of use of the photoreceptor unit, and to use the representative value after a preset condition on a use amount of the photoreceptor unit has been satisfied. This is because not so high accuracy is not required for life management in the early phase.

In the image formation device according to the aspect, the preset condition is preferably a preset threshold for the cumulative use amount of the photoreceptor unit. Alternatively, the preset condition is preferably the consumption rate calculated by the photoreceptor life management section or a preset threshold of the film thickness of the photoreceptor obtained in course of calculation of the consumption rate. The thresholds for these indicators allow switching from life management using the fixed value to life management based on the charging current at proper timing.

In the image formation device according to any of the other aspects, when the film thickness decreasing gradient is initially calculated by the film thickness decrease calculation section, the film thickness decreasing gradient holding section preferably holds the calculated film thickness decreasing gradient. This is because there is, at the time, no previously-held film thickness decreasing gradient.

In the image formation device according to any of the other aspects, the image formation device preferably further comprises: an environment condition storage section configured to store an environment condition when the charging current is measured, wherein the film thickness decrease calculation section is preferably configured such that only a charging current measured under a preset environment condition is available for calculation of the film thickness decreasing gradient. This is because accuracy lowering due to use of a charging current determined under extreme environment can be prevented.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 10 is a table of another example of the acceptable range of the development bias for the life of the development unit;

DESCRIPTION OF THE PREFERRED EMBODIMENTS

Figure 1:
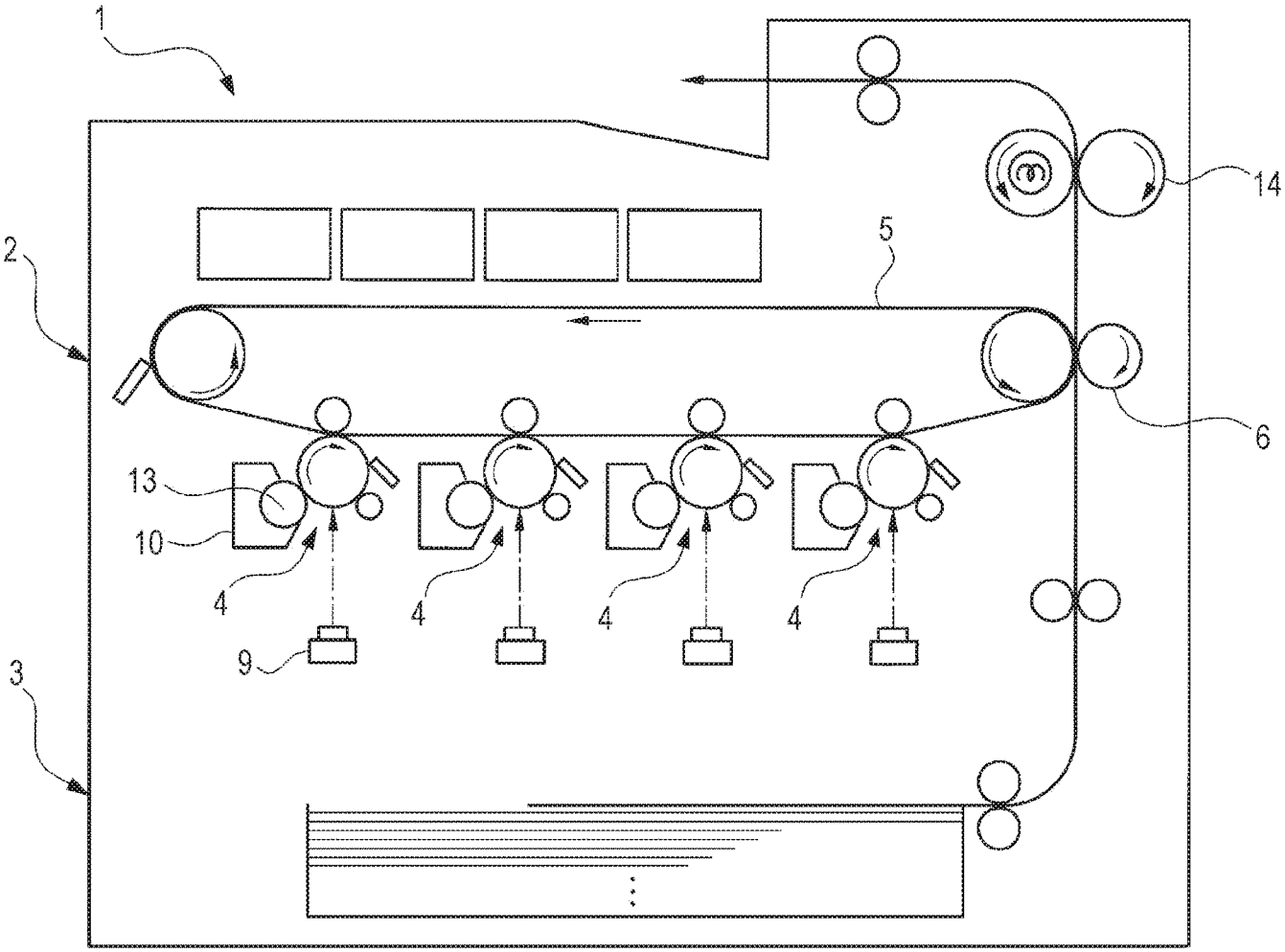
FIG. 1 is a cross-sectional view of an entire structure of an image formation device of an embodiment.

Hereinafter, an embodiment of the present invention will be described in detail with reference to the drawings. However, the scope of the invention is not limited to the illustrated examples. The present embodiment is made such that the present invention is applied to an image formation device 1 illustrated in FIG. 1. The image formation device 1 of FIG. 1 includes an image formation section 2 and a paper supply section 3. The image formation section 2 of the present embodiment is of a tandem double-transfer type with four image formation process sections 4, an intermediate transfer belt 5, and a secondary transfer roller 6. The image formation section 2 further includes a fixing device 14. With this configuration, a toner image is transferred onto paper supplied from the paper supply section 3 in the image formation section 2, and is fixed in the fixing device 14.

Figure 2:
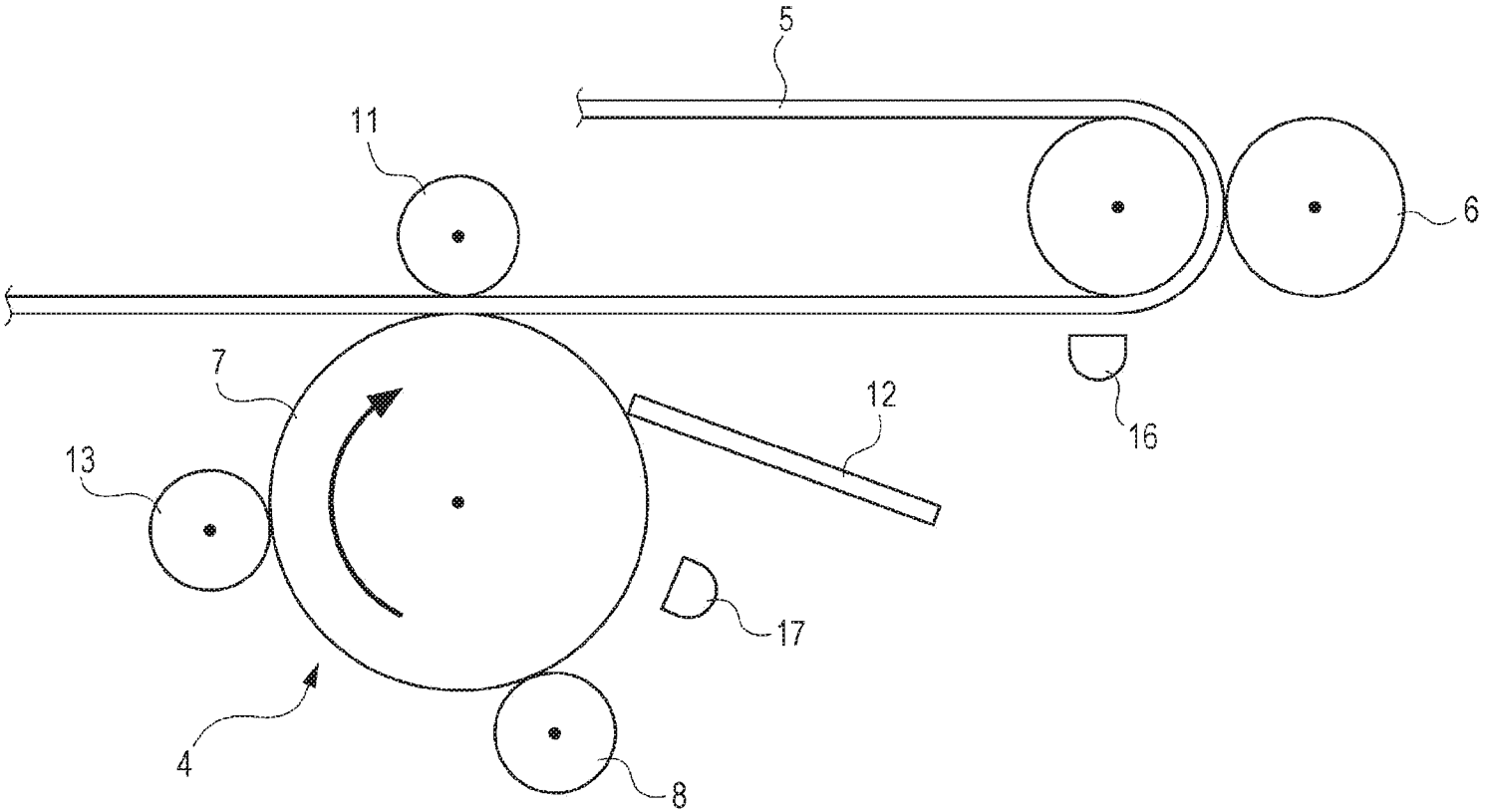
FIG. 2 is a cross-sectional view of a main portion of the image formation device of FIG. 1.

The four image formation process sections 4 correspond respectively to four colors of yellow (Y), magenta (M), cyan (C), and black (K). Each image formation process section 4 includes, as illustrated in FIG. 2, a photoreceptor 7, a charging roller 8, a development roller 13, a primary transfer roller 11, a cleaner 12, and an eraser 17. As illustrated in FIG. 1, an exposure section 9 is provided at each image formation process section 4. With this configuration, each image formation process section 4 transfers a toner image in a corresponding one of the colors onto the intermediate transfer belt 5. Note that the development roller 13 is part of a developer 10. Moreover, the image formation device 1 is provided with a density detection sensor 16. In the image formation device 1 of the present embodiment, the photoreceptor 7 and the developer 10 of the above-described components are independent replaceable units. Thus, these components will be sometimes referred to as a "photoreceptor unit 7" and a "development unit 10" in description below.

Figure 3:
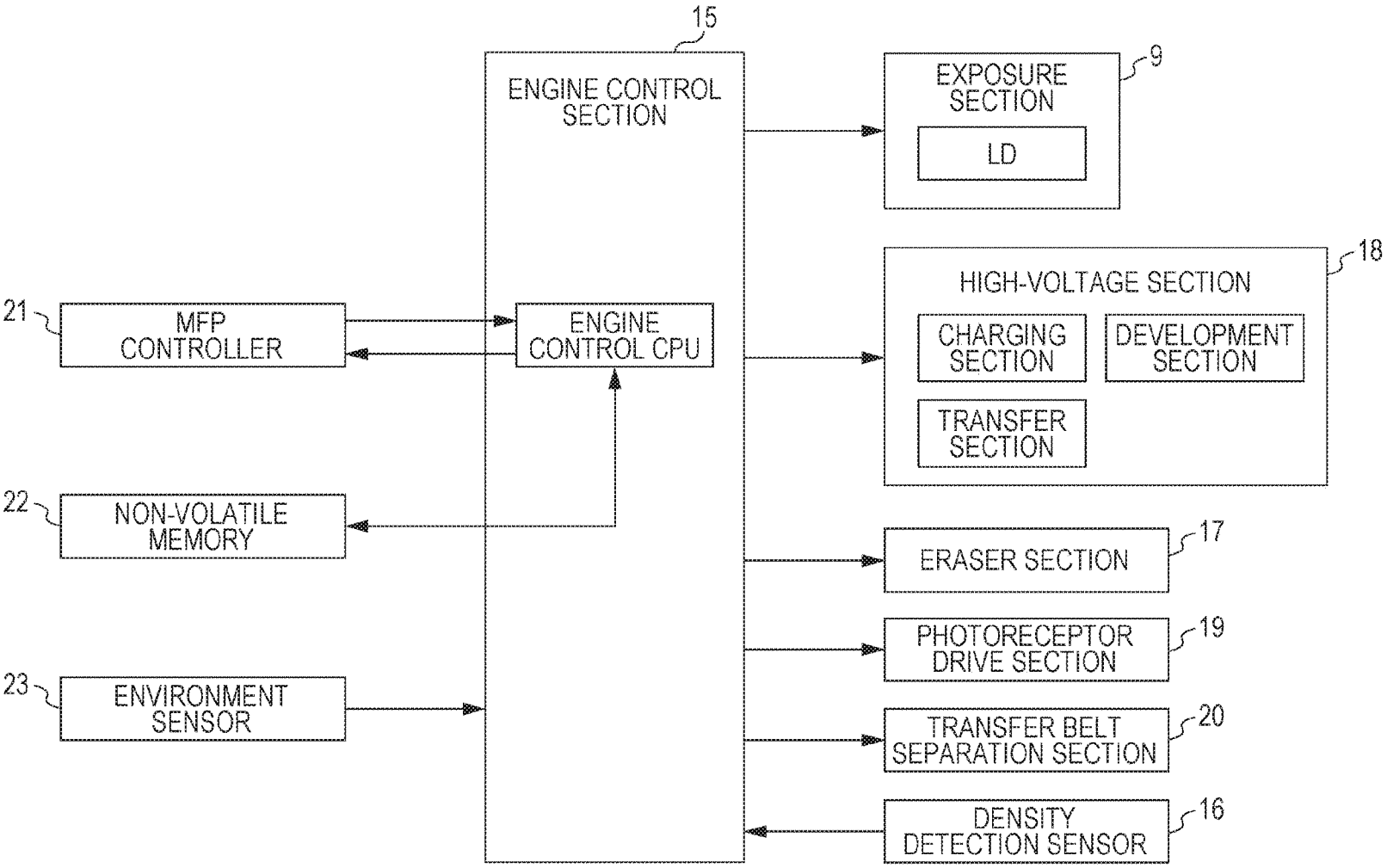
FIG. 3 is a block diagram of a configuration of a control system of the image formation device of FIG. 1.

A control system of the image formation device 1 of the present embodiment is configured as illustrated in FIG. 3. The control system of FIG. 3 is configured centering around an engine control section 15. The following components are connected to the engine control section 15: the exposure section 9; a high-voltage section 18 configured to apply each bias voltage for charging, development, and transferring; the eraser 17; a photoreceptor drive section 19 configured to drive the photoreceptor 7; a transfer belt separation section 20 configured to perform the operation of separating the intermediate transfer belt 5; the density detection sensor 16; a MFP controller 21 configured to communicate with a user interface and external equipment; a non-volatile memory 22 configured to store various parameters on execution of image formation; and an environment sensor 23.

First Embodiment

In an image formation device 1 of a first embodiment, image stabilization control is performed. The image stabilization control indicates that a bias condition of each component is readjusted such that a formed image has a target density. An optimal bias condition varies according to progression in durable use and an environment condition, and therefore, the image stabilization control is performed at proper timing. Of this image stabilization control, adhesion amount control is particularly focused in the present embodiment. The adhesion amount control indicates that a development bias is adjusted such that the amount of toner adhering to the photoreceptor 7 by the development roller 13 reaches an optimal amount.

Figure 4:
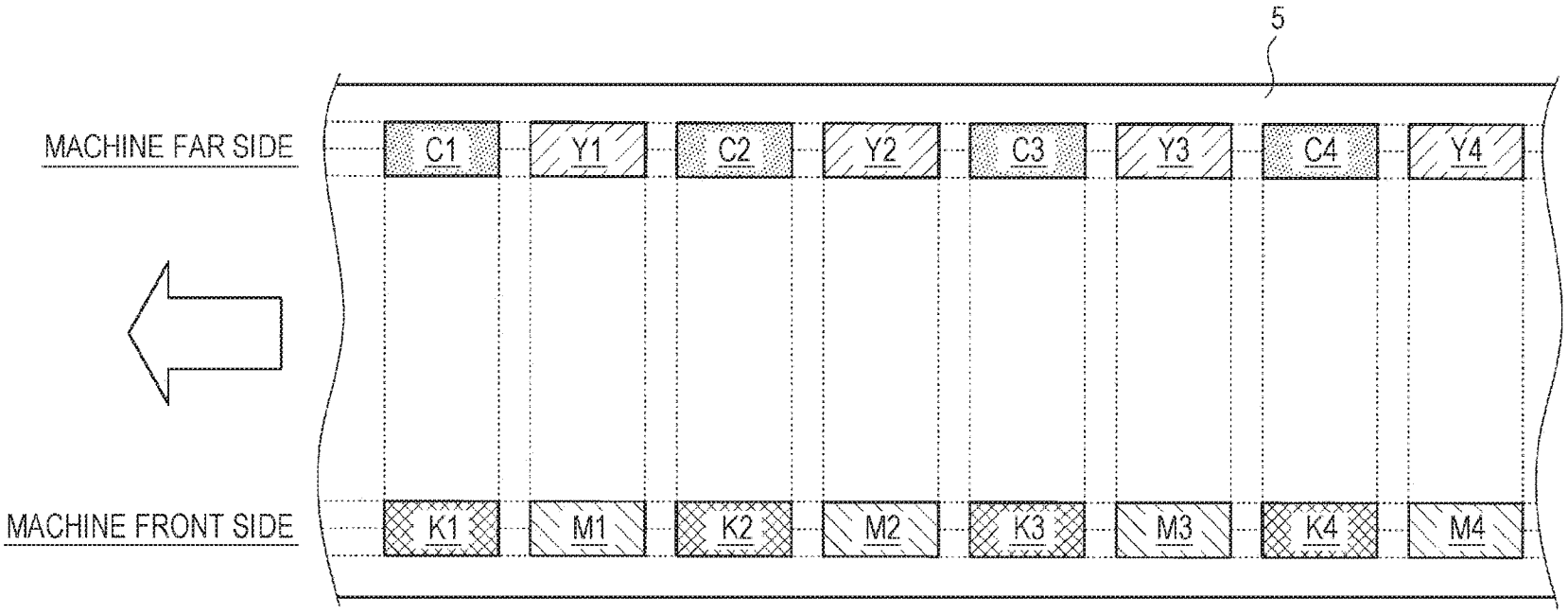
FIG. 4 is a plan view of a pattern formed in adhesion amount control.
Figure 5:
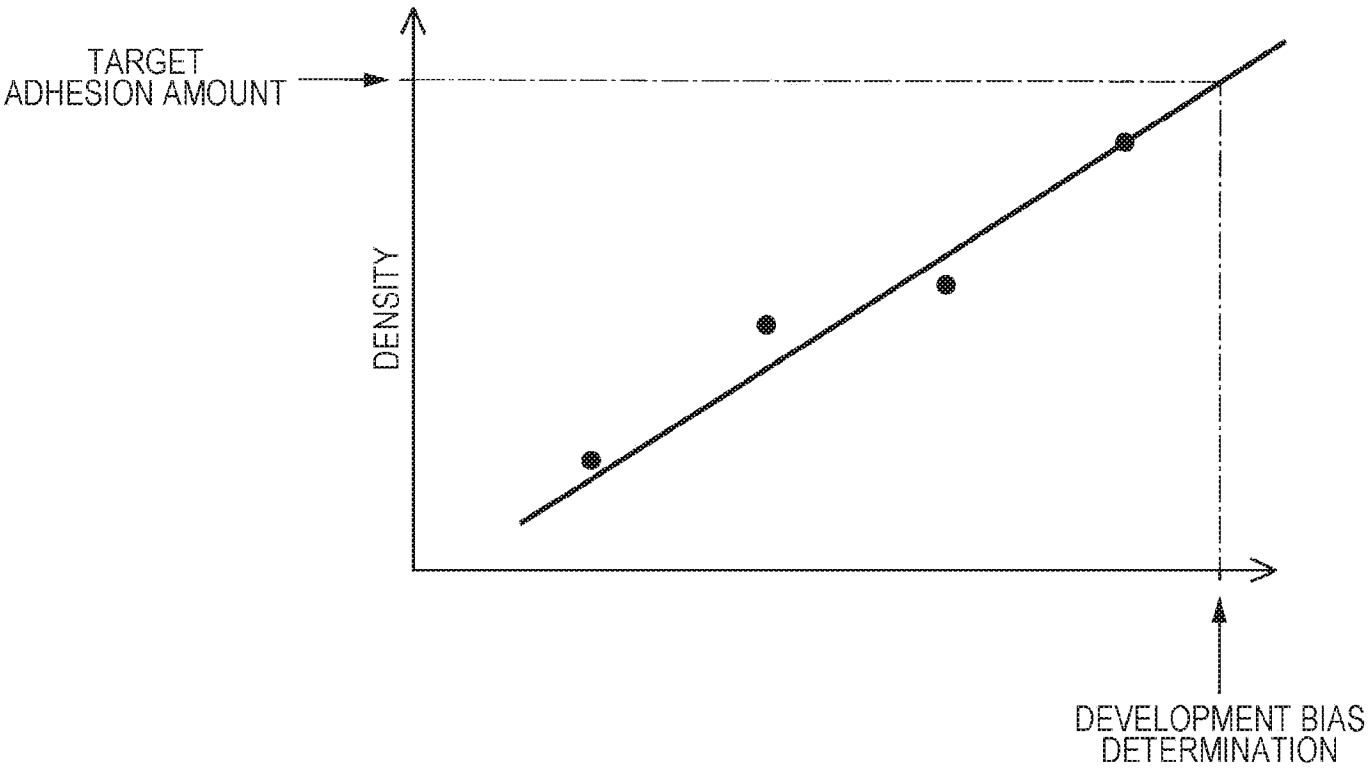
FIG. 5 is a graph of plots of a relationship between a development bias and a density in the adhesion amount control.

In the adhesion amount control of the present embodiment, four color patterns are formed with four types of development biases on the intermediate transfer belt 5, as illustrated in FIG. 4. The density of each color is measured by the density detection sensor 16. Then, a relationship between the development bias and the density is plotted for each color as illustrated in FIG. 5, and an approximation straight line is drawn. In this manner, the development bias corresponding to the density equivalent to a target adhesion amount is determined. In subsequent image formation, the development bias determined as described above is basically used. Note that the development bias is determined as described above separately for each color. Note that when the adhesion amount control is performed, the determined development bias is, with an environment value at the time, stored in the non-volatile memory 22. Further, the cumulative number of sheets printed by the development unit 10 at the time (described later) and a cumulative rotation time of the photoreceptor 7 at the time (also described later) are also stored in the non-volatile memory 22.

In the image formation device 1 of the present embodiment, management of the life of the development unit 10 is further performed. Such management will be described with reference to a flowchart of FIG. 6. This flowchart shows entire control of the image formation device 1, the control including normal image formation processing. In this flow, the processing is performed in the order of initial operation (S1), input/output processing (S2), printing control (S4), life management control (S5), image stabilization control (S6), and other types of control (S7). In this flow, the input/output processing (S2) is followed by determination on whether or not printing is initiated (S3). When no printing job is generated (S3: No), the printing control (S4) and the life management control (S5) of the above-described processing are not performed. When a printing job is generated (S3: Yes), the entire processing including the printing control (S4) and the life management control (S5) is performed.

Of the above-described processing, the printing control (S4) is the control processing of executing image formation. In addition to the printing control (S4), the initial operation (S1), the input/output processing (S2), and the other types of control (S7) are general processing, and for this reason, detailed description thereof will not be made. The life management control (S5) is the processing of managing the life of the development unit 10, and the contents thereof will be next described in detail with reference to FIG. 7. The image stabilization control (S6) includes the adhesion amount control as described above. Note that as described above, the image stabilization control is performed at optional timing. Specifically, such timing includes, e.g., timing right after power supply to the image formation device 1, timing in every image formation performed for the predetermined number of sheets, timing in every lapse of a predetermined time, or timing at shifting of the environment value. The image stabilization control (S6) of FIG. 6 also includes determination on the timing of executing the image stabilization control. Thus, when the processing proceeds to S6 of FIG. 6, pattern formation as illustrated in FIG. 4 is not always performed.

Figure 6:
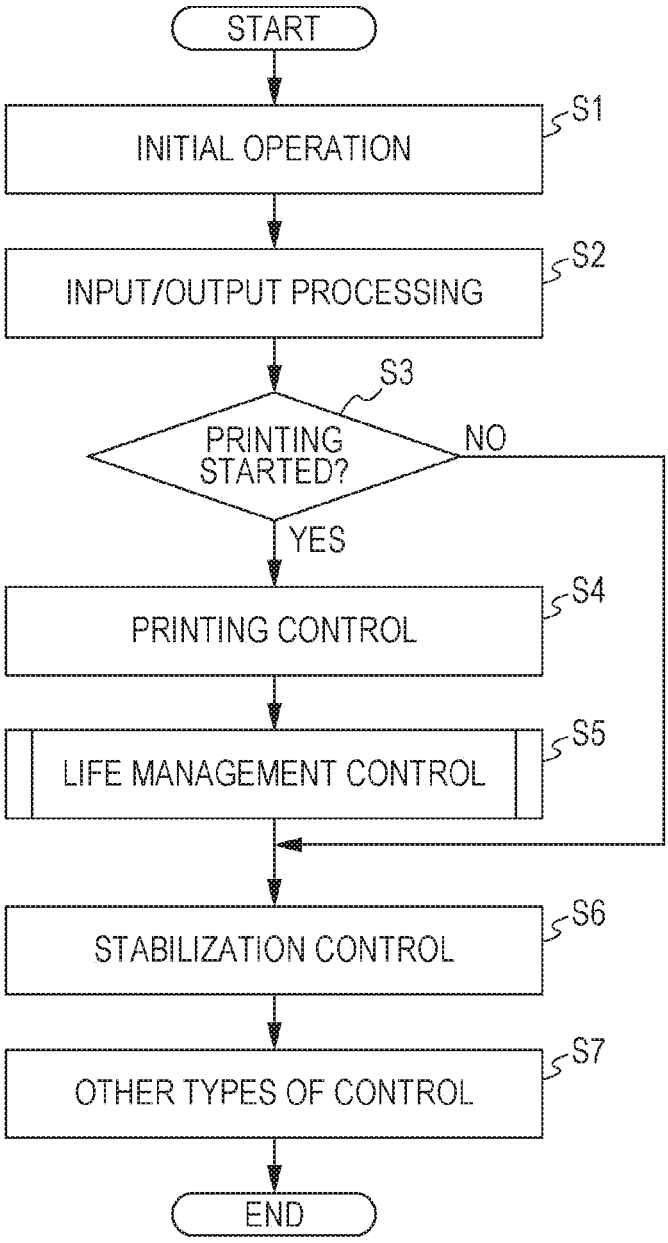
FIG. 6 is a flowchart of entire control of the image formation device according to a first embodiment.

The life management control (S5) will be described with reference to a flowchart of FIG. 7. In this flow, the rotation time of the photoreceptor 7 is first counted up (S51). This means that the cumulative rotation time of the photoreceptor 7 is updated. That is, the time of rotation of the photoreceptor 7 in the printing control (S4) right before the life management control (S5) in FIG. 6 is added to a previous cumulative rotation time, and in this manner, a new cumulative rotation time is obtained. The cumulative rotation time of the photoreceptor 7 is saved in the non-volatile memory 22 illustrated in FIG. 3. This cumulative rotation time is not only used for management of the life of the photoreceptor unit 7, but also relates to determination on the life of the development unit 10 at S56 as described later. Note that for each of the four colors of the photoreceptors 7, a value after recent replacement of the photoreceptor unit 7 is counted as the cumulative rotation time of the photoreceptor 7.

Next, the number of sheets printed by the development unit 10 is counted up (S52). This means that the cumulative number of sheets printed by the development unit 10 is updated. That is, the number of sheets for which image formation has been performed using the development unit 10 in the most-recent printing control (S4) is added to the previous cumulative number of printed sheets, and in this manner, the new cumulative number of printed sheets is obtained. For each of the four colors of the development units 10, a value after recent replacement is also counted as the cumulative number of sheets printed by the development unit 10, and is also saved in the non-volatile memory 22.

Next, the number of sheets printed by the development unit 10 is compared with a preset predetermined sheet number P1 (S53). The printed sheet number targeted for comparison at this step is, needless to say, the cumulative printed sheet number updated at S52 performed most recently. Moreover, the predetermined sheet number P1 is the number of sheets corresponding to "life stop" of a development unit 10 in a typical image formation device, i.e., the number of sheets leading to forced stop of image formation. The predetermined sheet number P1 is also saved in the non-volatile memory 22. Note that the predetermined sheet number P1 is not necessarily the same among the four colors. Thus, comparison at S53 is performed for each color.

When the printed sheet number does not reach the predetermined sheet number P1 (S53: No), the life management control of FIG. 7 is terminated. This is because the development unit 10 is still usable. When the printed sheet number reaches the predetermined sheet number P1 (S53: Yes), the remaining processing in the life management control is performed. That is, even when the printed sheet number reaches the sheet number leading to "life stop," life determination is further performed without promptly stopping image formation. This is because the typical "life stop" sheet number is often set to a safe side as described above. Note that a result of comparison of S53 may vary according to colors.

When it is determined as Yes at S53, it is checked whether or not there is an image stabilization control execution result (S54). At this step, only a result of the image stabilization control after the printed sheet number has reached the predetermined sheet number P1 is targeted. When there is no such an execution result (S54: No), the life management control of FIG. 7 is terminated. This is because data required for later-described life determination is not present.

When there is the corresponding execution result (S54: Yes), the environment value upon execution of the image stabilization control is further checked (S55). More specifically, it is checked whether or not environment in execution of the image stabilization control is normal quiet environment. This is because the execution result showing extreme temperature and humidity values is improper for use in life determination. Specifically, e.g., the environment value corresponding to an absolute humidity of 6.5 to 16 g/m$^3$ may be taken as proper environment. When the environment value is not proper (S55: No), the life management control of FIG. 7 is terminated. This is because there is, after all, no data which can be used for life determination. Note that checking results of S54 and S55 do not vary according to colors.

Figure 8:
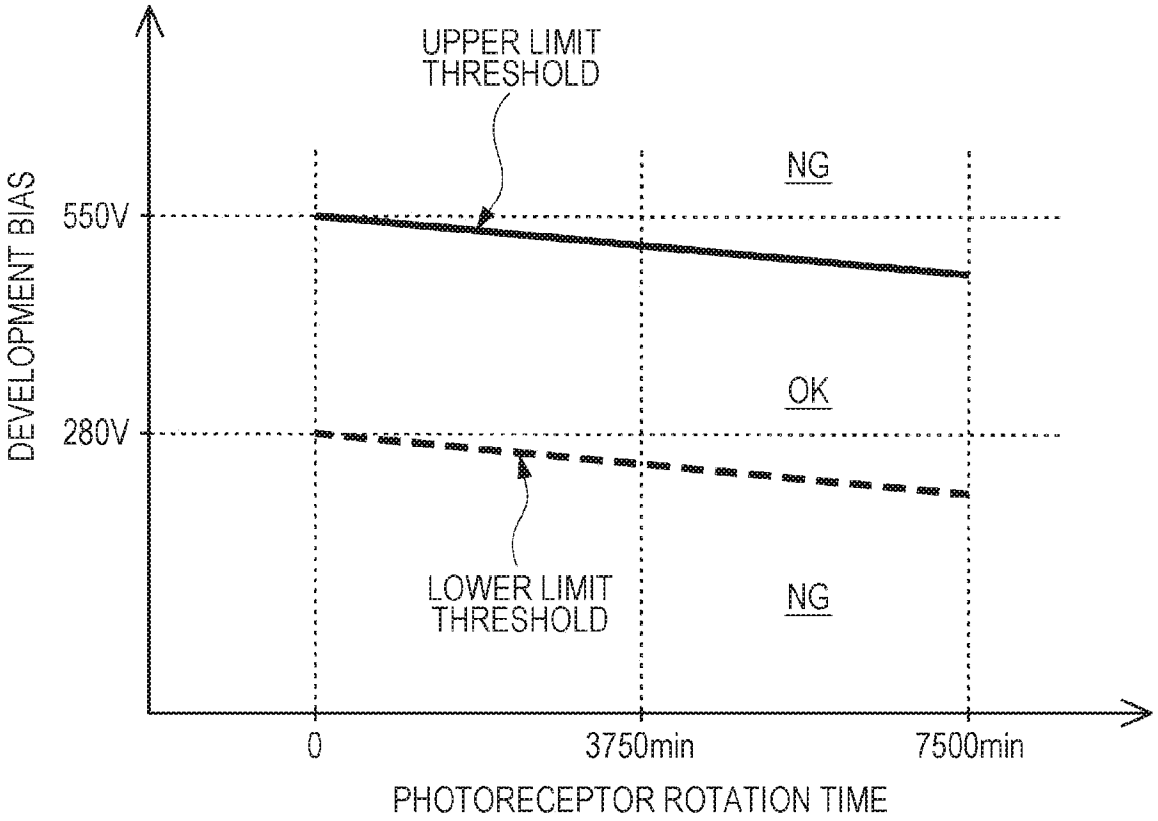
FIG. 8 is a graph of an acceptable range of the development bias for the life of the development unit.

When the environment value is proper (S55: Yes), the life of the development unit 10 is determined (S56). Life determination at this step is performed using a graph of FIG. 8. The graph of FIG. 8 shows an acceptable range of the development bias in determination of the life of the development unit 10. In FIG. 8, two straight lines extending downward to the right are drawn to show an "upper limit threshold" and a "lower limit threshold." A region between these two straight lines is an OK region, and outer regions on both sides of the OK region are NG regions. That is, a voltage value of the development bias has a certain acceptable range, and it is determined as expiration of the life of the development unit 10 even when the voltage value deviates up and down. The development bias exceeding the upper limit threshold indicates that a toner delivery capacity of the development roller 13 is lowered beyond an acceptable range. The development bias falling below the lower limit threshold indicates that a toner charging amount increases beyond an acceptable range.

Tendency shows that both of the upper and lower limit thresholds decrease in parallel as the cumulative rotation time of the photoreceptor increases. The "upper limit threshold" and the "lower limit threshold" illustrated in FIG. 8 are graphs represented by the following expressions. Numerical values in these expressions are an example of experimentally-determined values. Thus, these numerical values may vary according to colors. Moreover, these numerical values may vary according to individuals.

Figure 9:
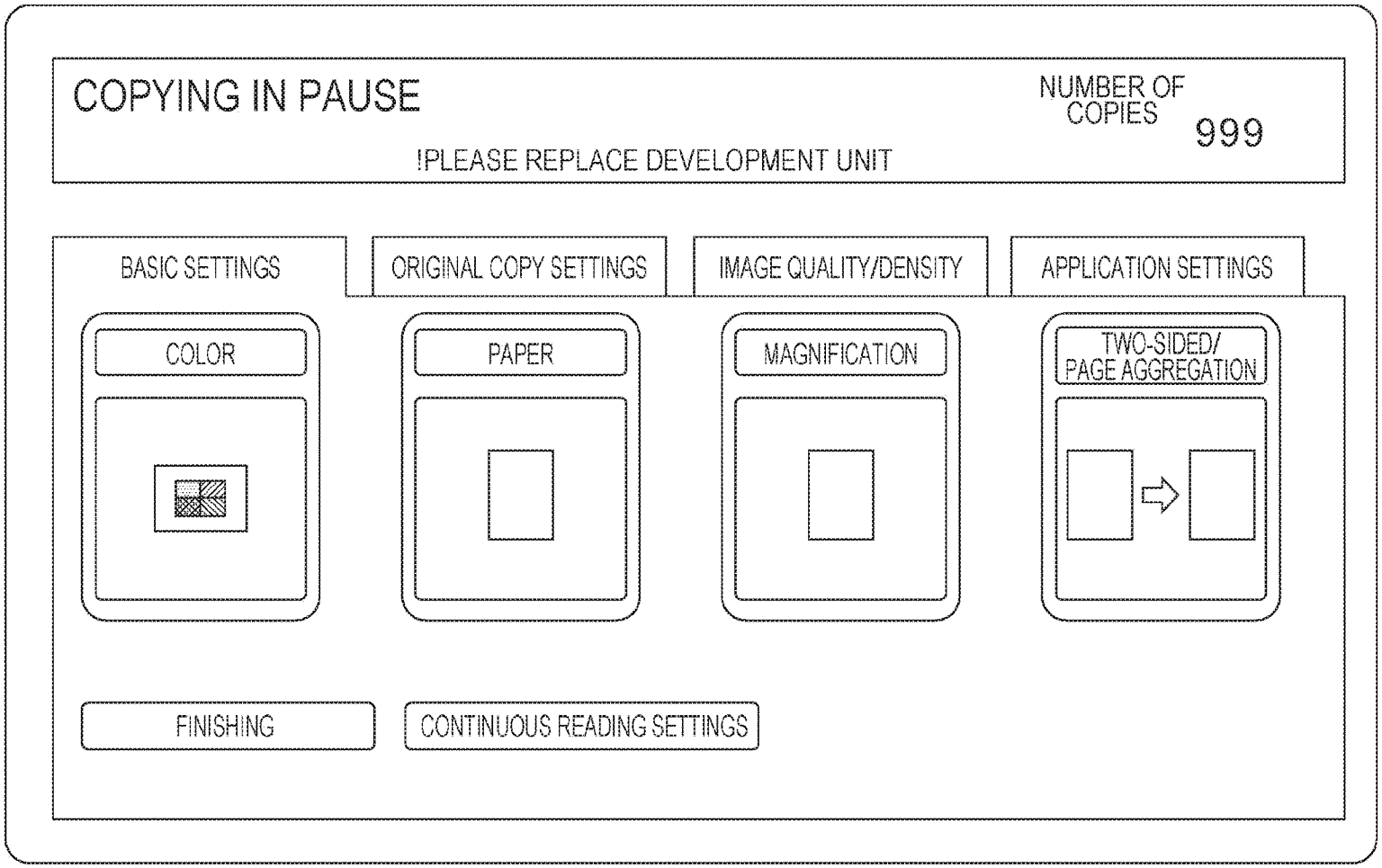
FIG. 9 is a plan view of a display example of an operation/display panel upon expiration of the life of the development unit.

Upper Limit Threshold [V]=550−0.0081×Cumulative Rotation Time [Minutes] of Photoreceptor Lower Limit Threshold [V]=280−0.0081×Cumulative Rotation Time [Minutes] of Photoreceptor In determination on the life of the development unit 10, the development bias value determined in the target image stabilization control (new one if there are two or more controls) determined as Yes at S55 and the cumulative rotation time of the photoreceptor 7 at the time are plotted in FIG. 8. When such a plot is within the OK region, it is determined that the development unit 10 can be still continuously used. When the plot is within the NG region, it is determined that the development unit 10 can be no longer continuously used. In this case, measures such as forced stop of further image formation are taken. Moreover, as illustrated in FIG. 9 as an example, a message for prompting a user to replace the development unit 10 is displayed on an operation/display panel of the image formation device 1. If possible, a voice announcement may be made. Needless to say, a result of determination on the life of the development unit 10 may vary according to colors.

Note that life determination at S56 may be performed using a table of FIG. 10 instead of using the graph of FIG. 8. The table of FIG. 10 is a table showing the upper and lower limit thresholds for each of the four colors according to two levels of cumulative rotation time of the photoreceptor 7. The two levels of cumulative rotation time in FIG. 10 include a level of less than a rotation time corresponding to three hundred thousand rotations and a level of equal to or greater than such a rotation time. For any of the thresholds of FIG. 10, the threshold for the level of equal to or greater than three hundred thousand rotations is less than that for the level of less than three hundred thousand rotations. Such a point matches the graph extending downward to the right in FIG. 8.

When life determination is performed using the table of FIG. 10, it is first checked whether the cumulative rotation time in determination of the target development bias value is at the level of less than three hundred thousand rotations or the level of equal to or greater than three hundred thousand rotations. Using the upper and lower limit thresholds for the corresponding level, it is determined whether the target development bias value is within the OK region or the NG region. That is, it can be said that the technique of determination according to the table of FIG. 10 is a simple version of the technique of determination according to the graph of FIG. 8. Note that the cumulative rotation time of the photoreceptor 7 is categorized into the two levels in the table of FIG. 10, but may be categorized into more levels. Moreover, the thresholds actually shown in FIG. 10 are examples, and may be other numeral values.

Figure 7:
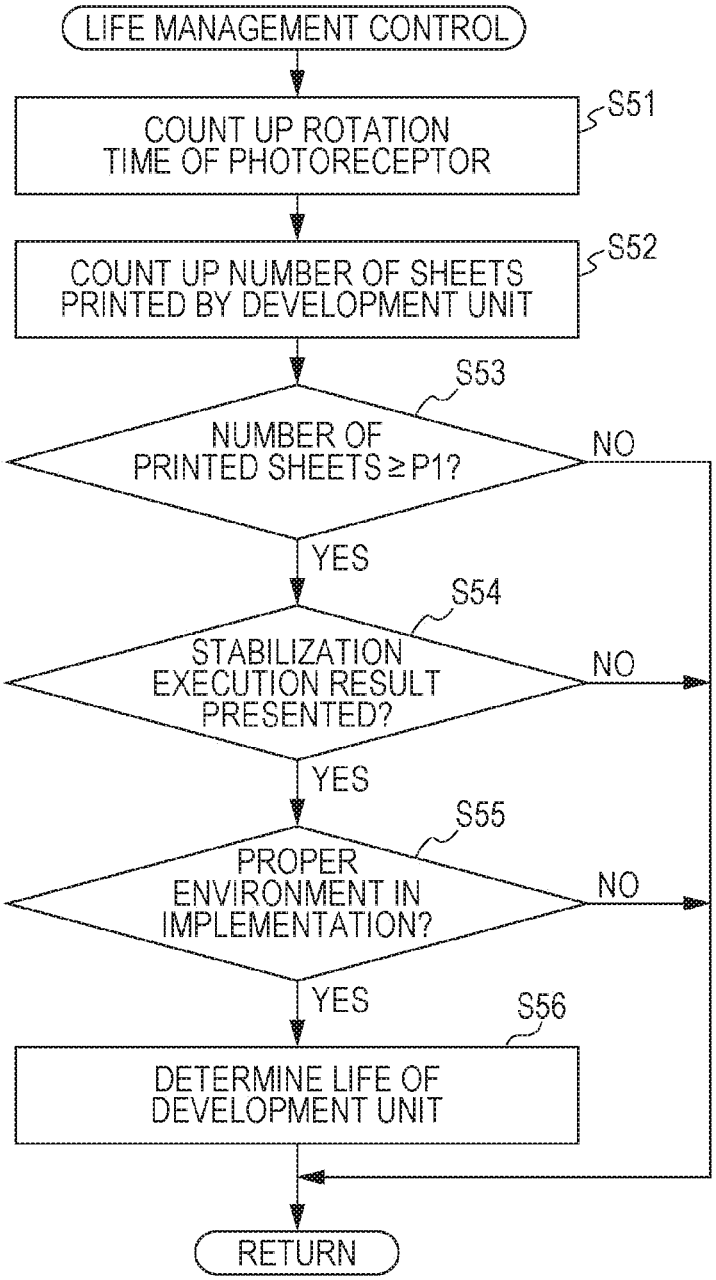
FIG. 7 is a flowchart of life management control of a development unit.

In description above, only when the environment value in execution of the target image stabilization control is proper, the life of the development unit 10 is determined at S55 of FIG. 7. However, not only such determination is made, but also the life of the development unit 10 can be also determined when the environment value is not proper. For such determination, the upper and lower limit thresholds of FIG. 8 or 10 may be prepared according to the environment value in the image stabilization control.

Note that generally in the image formation device of this type, a message for preannouncing expiration of the life of the development unit 10 is often displayed prior to the message upon stop of image formation as illustrated in FIG. 9. For displaying such a preannouncement message in the present embodiment, the message can be displayed when determination at S53 of FIG. 7 is made as "Yes." Alternatively, it may be configured such that the preannouncement message is displayed based on the printed sheet number (equivalent to a "life" slightly before "life stop" in a typical machine) slightly before determination at S53 of FIG. 7 is made as "Yes." Note that in the first embodiment, the photoreceptor 7 being configured as a replaceable photoreceptor unit 7 is not a requirement.

As described above in detail, according to the present embodiment, the life of the development unit 10 is determined using the development bias value determined by the adhesion amount control as part of the image stabilization control. The development bias value determined as described above reflects, to some extent, not only the status of deterioration of the development unit 10, but also the progress status of deterioration of the photoreceptor 7. Thus, upon setting of the acceptable range in life determination, there is no need to take a great safe margin into consideration. For this reason, the image formation device 1 can be realized, which allows such life determination that the development unit 10 is replaced after the potential life thereof has been effectively used up.

In particular, the acceptable range itself in life determination is shifted according to a cumulative use amount of the photoreceptor unit 7 so that the life of the development unit 10 can be more favorably used up. Moreover, only the development bias value under a proper environment condition in determination is used as the development bias value in life determination, and therefore, the life can be determined with a higher accuracy. Even in this case, no transition is made without being able to determine the life for a long period of time. This is because the proper environment condition is, in many cases, also an environment condition seen with a high frequency.

Second Embodiment

The configuration illustrated in FIGS. 1 to 3 is common between an image formation device 1 of a second embodiment and the image formation device 1 of the first embodiment. In the second embodiment, life management of a photoreceptor unit 7 is performed. In the second embodiment, the life of the photoreceptor unit 7 is managed using a charging current. The charging current described herein is a current flowing between a charging roller 8 and the photoreceptor 7 in the state in which the same charging bias as that in image formation is applied to between the charging roller 8 and the photoreceptor 7. Note that the charging current is not measured at timing during image formation, but is measured at optional timing when no image formation is performed. Specifically, the charging current is measured at the timing of executing charging adjustment for optimizing the charging bias (particularly a peak-to-peak value of an AC component of the charging bias). For example, charging adjustment is performed right after power supply to the image formation device 1, in every image formation performed for the predetermined number of sheets, in every lapse of a predetermined time, or in shifting of an environment value.

The charging current described herein is inverse proportional to the film thickness of the photoreceptor 7 (more specifically, the film thickness of a photosensitive layer on a surface of the photoreceptor 7). Thus, there is a relationship between the charging current and the film thickness of the photoreceptor 7 as illustrated in a graph of FIG. 11. Thus, the film thickness of the photoreceptor 7 can be obtained from the charging current. With the obtained film thickness, a decrement (a decreasing gradient) in the film thickness of the photoreceptor 7 per rotation time from a brand-new state to a current state of the photoreceptor 7 is obtained by the following expression. The "current" as described herein means the point of measurement of the charging current. An initial film thickness is a known value according to specifications.

Decreasing Gradient=(Initial Film Thickness−Current Film Thickness)/Current Cumulative Rotation Time With the decreasing gradient determined as described above, when the film thickness progressively decreases due to subsequent image formation, the film thickness at the time can be estimated. Thus, the film thickness at the time can be estimated in every image formation without measurement of the charging current with a high frequency. With the estimated film thickness, the consumption rate of the photoreceptor 7 can be obtained by the following expression. This allows determination on the life of the photoreceptor unit 7. The "current" described herein means the point of image formation (after the point of measurement of the charging current). The lower film thickness limit is a defined value in designing. With the obtained consumption rate, expiration of the life can be determined, and can be announced in advance.

Consumption Rate=(Initial Film Thickness−Current Film Thickness)/(Initial Film Thickness−Lower Film Thickness Limit)

Meanwhile, the film thickness of the photoreceptor 7 decreases at a constant speed as durable use progresses. Thus, in FIG. 11, a change in the charging current in association with a decrease in the film thickness becomes greater as the durable use of the photoreceptor 7 progresses. This means that the accuracy of the film thickness of the photoreceptor 7 calculated from the charging current increases toward the end of the durable use. Thus, in life determination of the photoreceptor unit 7 as described above, a higher accuracy can be also expected by use of as recent charging current value as possible. However, there is also a variation in charging current measurement itself due to, e.g., an environment factor. For this reason, it is not always preferable to use only the latest charging current value.

Thus, in the present embodiment, the charging current values previously obtained multiple times are used while the decreasing gradient is determined with a newer charging current value being weighted. With this configuration, the high-accuracy new charging current value is emphasized while excessive influence of the measurement variation is eliminated.

Figure 12:
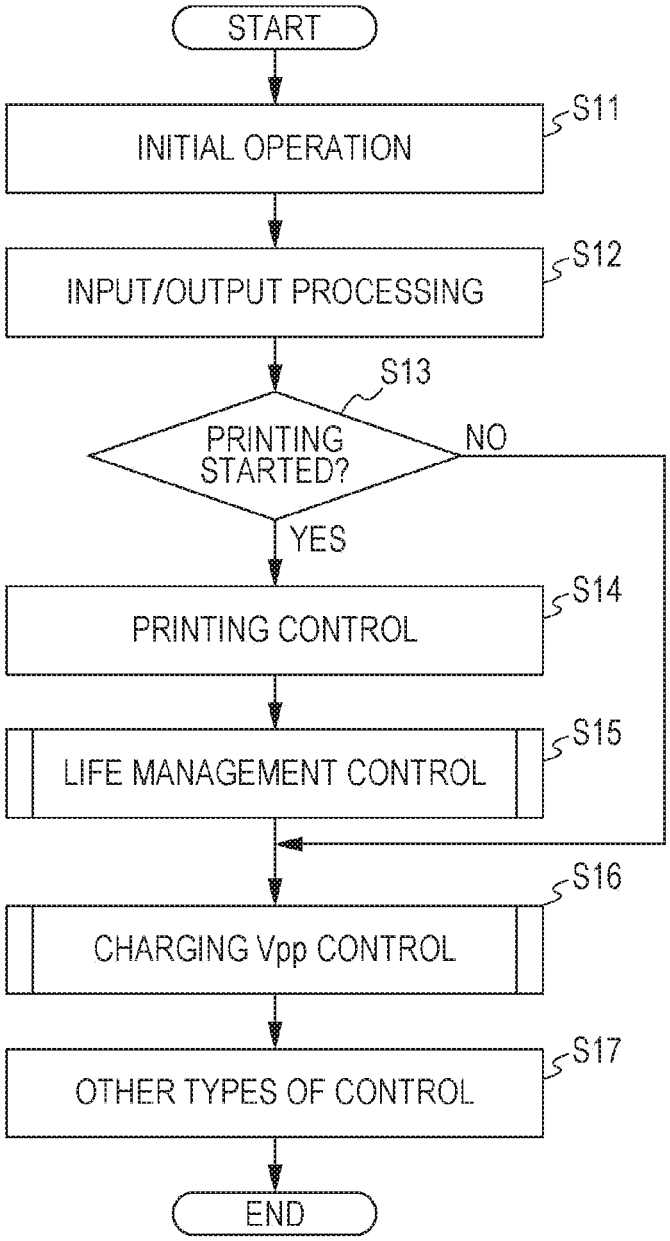
FIG. 12 is a flowchart of entire control of an image formation device according to a second embodiment.
Figure 13:
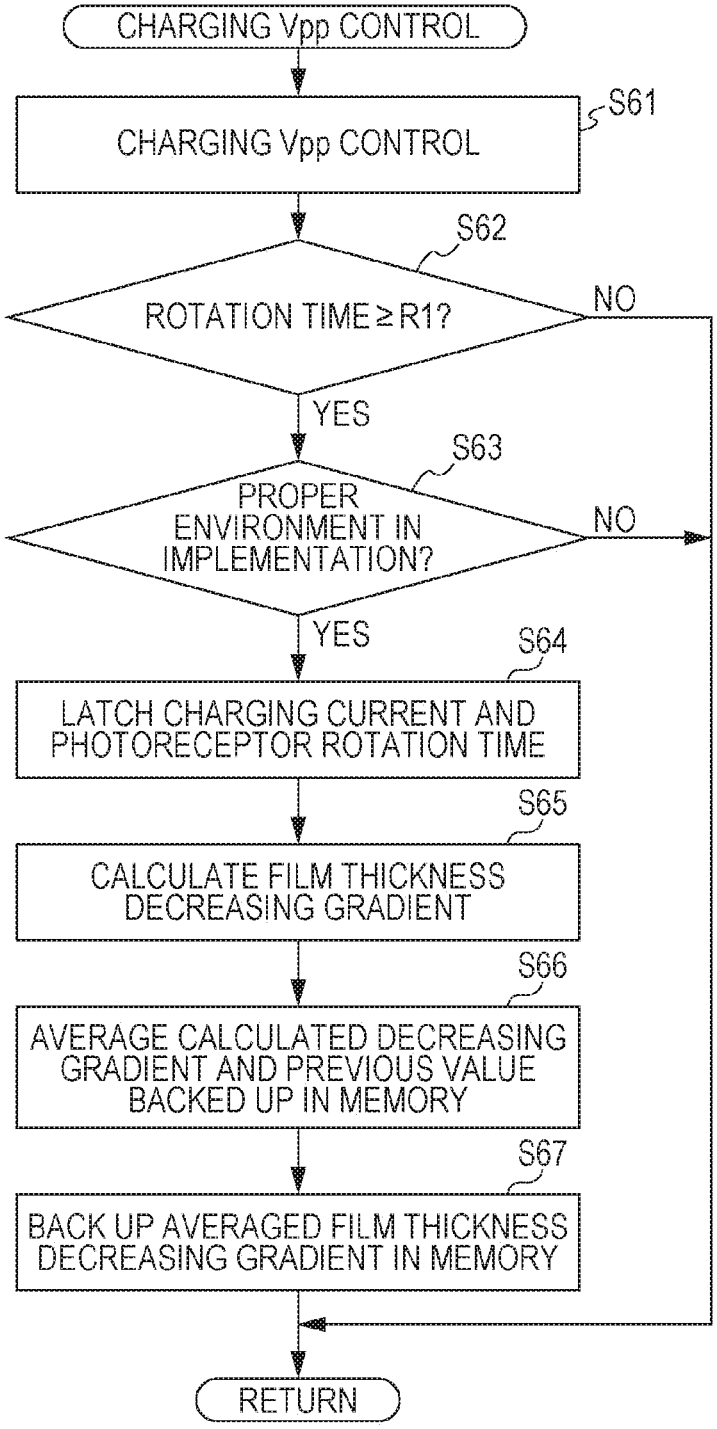
FIG. 13 is a flowchart of charging Vpp control for photoreceptor unit life management.
Figure 14:
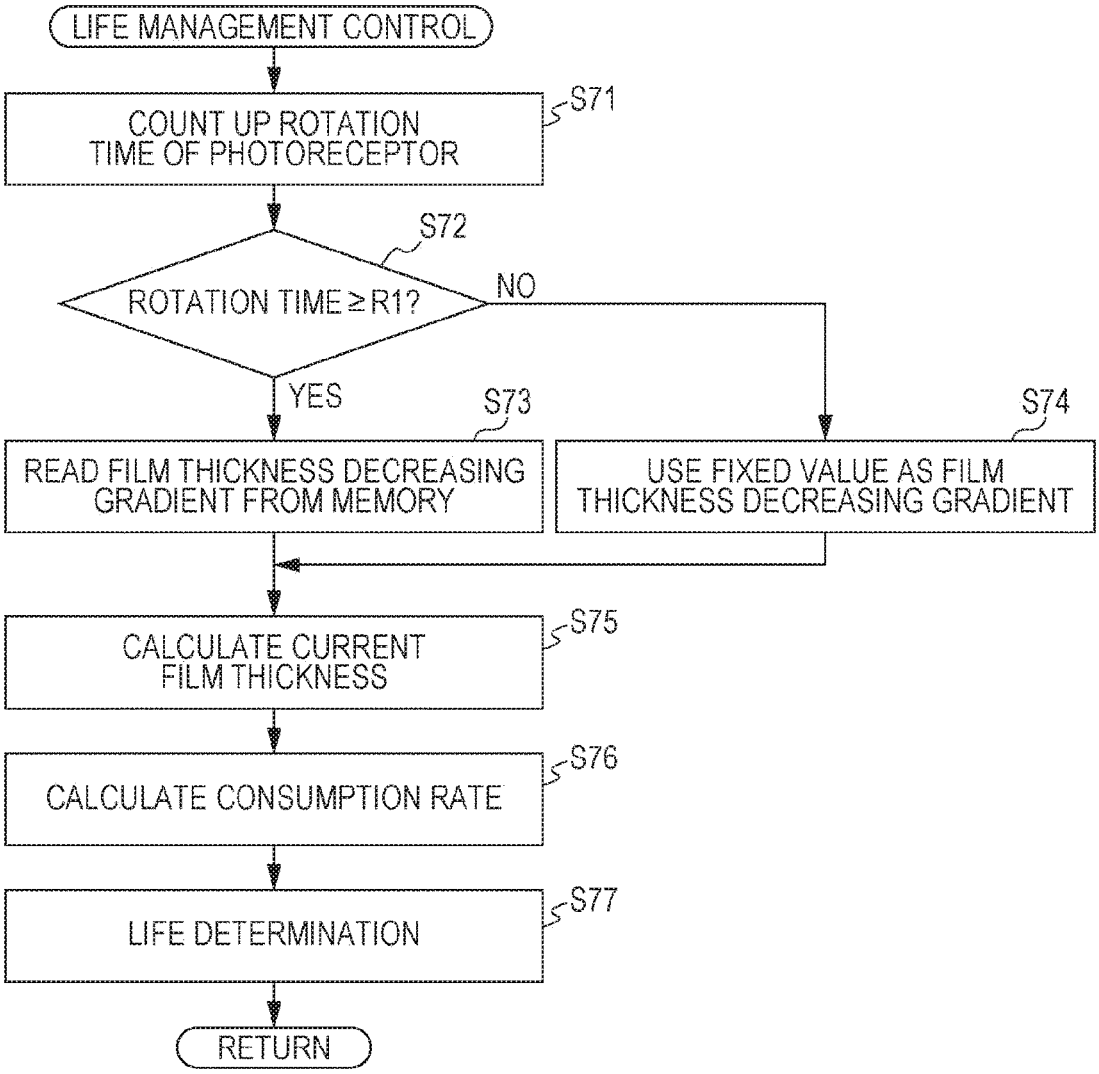
FIG. 14 is a flowchart of photoreceptor unit life management control.

A control flow of such life management of the photoreceptor unit 7 is illustrated in FIGS. 12 to 14. First, FIG. 12 illustrates entire control of the image formation device 1, the control including normal image formation processing. In this flow, the processing is performed in the order of initial operation (S11), input/output processing (S12), printing control (S14), life management control (S15), charging Vpp control (S16), and other types of control (S17). In this flow, the input/output processing (S12) is followed by determination on whether or not printing is initiated (S13). When no printing job is generated (S13: No), the printing control (S14) and the life management control (S15) of the above-described processing are not performed. When a printing job is generated (S13: Yes), the entire processing including the printing control (S14) and the life management control (S15) is performed.

Of the above-described processing, the initial operation (S11), the input/output processing (S12), the printing control (S14), and the other types of control (S17) are the same as those described with reference to FIG. 6. The life management control (S15) is the processing of managing the life of the photoreceptor unit 7, and the contents of such processing will be described in detail with reference to FIG. 14. The charging Vpp control (S16) is charging adjustment as described above and measurement of the charging current in association with such charging adjustment, and will be next described with reference to FIG. 13. Note that as described above, charging adjustment is performed at optional timing, and therefore, charging adjustment etc. are not always performed when the processing proceeds to S16 of FIG. 12.

The charging Vpp control (S16) will be described with reference to a flowchart of FIG. 13. Note that FIG. 13 illustrates the processing when it comes to the optional timing at which charging adjustment needs to be performed. When it does not come to the optional timing, the entire processing of FIG. 13 is skipped even when the processing proceeds to S16 of FIG. 12.

In this flow, the charging Vpp control is first performed (S61). That is, charging adjustment as described above and measurement of the charging current in association with such charging adjustment are performed. The contents of these processes are generally known, and therefore, will not be described in detail. Note that a determined charging bias and a measured charging current value are not always the same among four colors. The processing is further continued even after S61 of FIG. 13. Such processing is the processing of adjusting data required for the life management control described with reference to FIG. 14. That is, S16 of FIG. 12 includes not only the charging Vpp control, but also the preparatory processing for the life management control.

After the charging Vpp control of S61, a rotation time of the photoreceptor 7 is compared with a preset predetermined rotation time R1 (S62). The rotation time targeted for comparison as described herein is a cumulative rotation time of the photoreceptor unit 7 at the point at which the most-recent charging Vpp control of S61 is performed. The predetermined rotation time R1 is a rotation time set in advance corresponding to around a start point of a rising gradient of the graph of FIG. 11. Such a rotation time is a rotation time shorter than a rotation time corresponding to generally-known "life stop," i.e., a rotation time leading to forced stop of image formation. The predetermined rotation time R1 is also saved in a non-volatile memory 22. Note that the predetermined rotation time R1 is not necessarily the same among the four colors. Thus, comparison at S62 is performed for each color.

When the rotation time does not reach the predetermined rotation time R1 (S62: No), the processing of FIG. 13 is terminated at this point. This is because there is still a plenty of time until expiration of the life of the photoreceptor unit 7, and there is no need to precisely manage the life. Moreover, this is because the graph of FIG. 11 still shows a gentle gradient, and reliability of the measured charging current value is not so high. When the rotation time reaches the predetermined rotation time R1 (S62: Yes), the processing of FIG. 13 is further performed. Note that a comparison result of S62 may vary according to colors.

When it is determined as Yes at S62, the environment value is checked (S63). More specifically, it is checked whether or not environment upon measurement of the charging current in the charging Vpp control is normal quiet environment. This is because a measurement result showing extreme temperature and humidity values is improper for use in life determination. Specifically, it may be determined whether or not the environment value is proper as described above with reference to S55 of FIG. 7. When the environment value is not proper (S63: No), the processing of FIG. 13 is terminated at this point. This is because there is no charging current value which can be used for life determination. Note that a checking result of S63 does not vary according to colors.

When the environment value is proper (S63: Yes), the charging current value and the rotation time of the photoreceptor 7 are latched (S64). That is, the charging current value measured at S61 and the cumulative rotation time of the photoreceptor unit 7 at the time are temporarily saved. Using the latched charging current value and rotation time, the decreasing gradient at a current point is calculated by the above-described expression (S65). Subsequently, the average of the decreasing gradient newly calculated at S65 and the decreasing gradient backed up in the non-volatile memory 22 is obtained (S66). The backed-up decreasing gradient is the decreasing gradient used for the previous life management control (S15 of FIG. 12, FIG. 14).

Then, the obtained average is backed up as a new decreasing gradient in the non-volatile memory 22 (S67). In this manner, the value of the decreasing gradient is updated. The updated value of the decreasing gradient reflects the latest charging current value with a weighting of 50%, but is not calculated using only the latest charging current value. The above-described processing is the charging Vpp control of FIG. 13. Note that when the decreasing gradient is initially calculated (S65) for the photoreceptor unit 7 at S66 and S67, the calculated decreasing gradient may be backed up as it is.

Subsequently, the life management control (S15) of FIG. 12 will be described with reference to a flowchart of FIG. 14. In this flow, the rotation time of the photoreceptor 7 is first counted up (S71). This is the same as S51 of FIG. 7. That is, the time of rotation of the photoreceptor 7 in the printing control (S14) right before the life management control (S15) in FIG. 12 is added to a previous cumulative rotation time, and in this manner, a new cumulative rotation time is obtained.

Next, the rotation time of the photoreceptor 7 is compared with the above-descried predetermined rotation time R1 (S72). Such comparison itself is the same as that of S62 of FIG. 13. Note that the rotation time of the photoreceptor 7 at S72 is the cumulative rotation time of the photoreceptor unit 7 at the time of the most-recent printing control (S14 of FIG. 12).

When the rotation time reaches the predetermined rotation time R1 (S72: Yes), the value of the decreasing gradient of the film thickness is read from the non-volatile memory 22 (S73). The read value of the decreasing gradient is the latest value backed up at S67 of FIG. 13 as described above. On the other hand, when the rotation time does not reach the predetermined rotation time R1 (S72: No), it is determined that not the value backed up at S67 but a fixed value prepared in advance is used as the decreasing gradient (S74).

Subsequently, the current film thickness of the photoreceptor 7 is calculated (S75). That is, a decrement in the film thickness due to execution of image formation after previous film thickness calculation is obtained using the decreasing gradient, and then, is subtracted from the previously-calculated film thickness. Then, the consumption rate is calculated (S76). When the consumption rate is calculated, the life is determined (S77). That is, the calculated consumption rate is compared with, e.g., a preset limit value or a preset prediction value, and optional processing (e.g., a preannouncement message or forced stop) is performed according to a comparison result. The above-described processing is processing in the flow of FIG. 14.

Life management of the photoreceptor unit 7 in the image formation device 1 of the second embodiment actually transitions as follows. That is, it is inevitably determined as No at S72 of FIG. 14 for a certain time after the brand-new state of the photoreceptor unit 7. Thus, life determination (S75 to S77) is performed using not the decreasing gradient calculated by the charging Vpp control (S16, FIG. 13), but the decreasing gradient (S74) prepared as the fixed value in advance. Thus, during such a period, measurement of the charging current is, unless otherwise needed, not necessarily performed upon the charging Vpp control (FIG. 13).

When the cumulative rotation time of the photoreceptor 7 reaches the predetermined rotation time R1, it is determined as Yes at S62, and the decreasing gradient is prepared based on the actually-measured charging current value. Then, in the life management control, determination at S72 is also changed to Yes, and life determination (S75 to S77) is performed using the decreasing gradient (S73) based on the actual measurement value. Thus, the accuracy of life determination increases as compared to the case of using the fixed value as the decreasing gradient. This is because the decreasing gradient based on the actual measurement value reflects an individual difference in the photoreceptor unit 7 and an actual image formation condition.

Thereafter, the value of the decreasing gradient is updated every time the charging Vpp control (S16) is executed (S67). At this step, the average of the previous decreasing gradient and the latest decreasing gradient (S66) is backed up as a new decreasing gradient. Thus, a greatest weighting of 50% is on the latest decreasing gradient, and a smaller weighting is on an older decreasing gradient. Meanwhile, only the latest decreasing gradient is not used, and therefore, influence of a variation in measurement of the charging current value is reduced. Note that the "average" calculated at S66 is not limited to a normal arithmetic average, and may be a geometric average or a harmonic average. Alternatively, such an average may be a weighting average for placing a greater weighting on the latest decreasing gradient.

Figure 11:
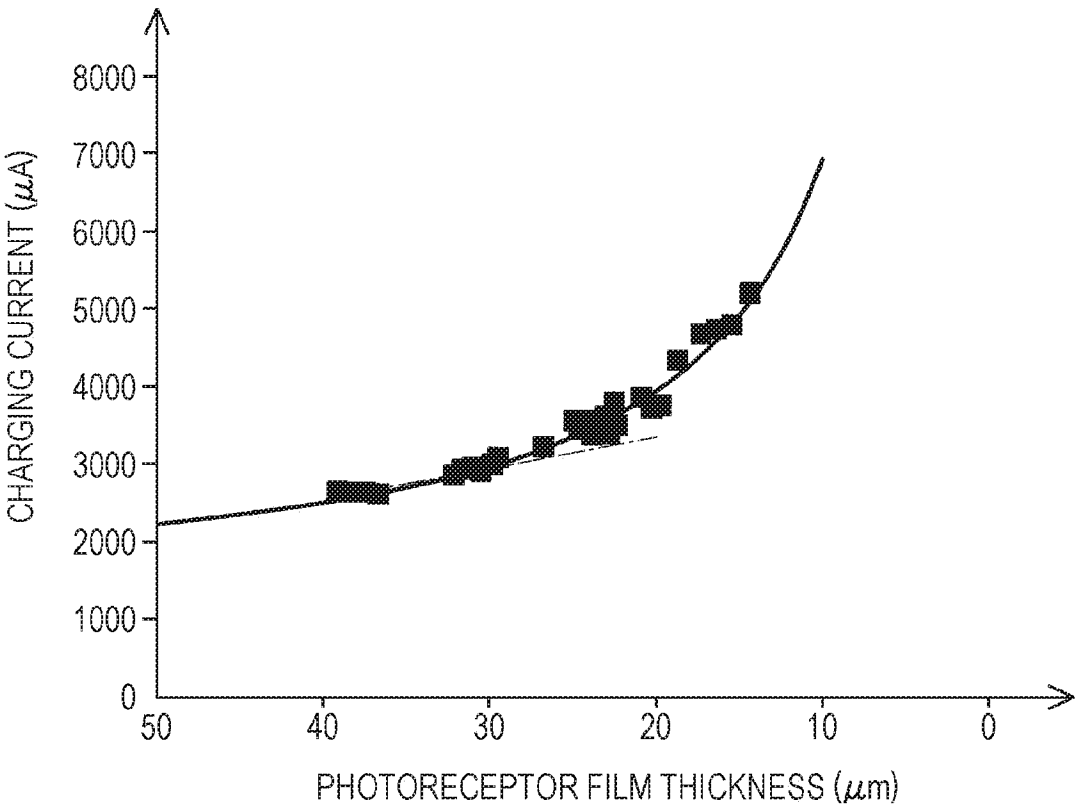
FIG. 11 is a graph of a relationship between a charging current and a photoreceptor film thickness.

Then, the rising gradient of the graph of FIG. 11 shows that the accuracy of measurement of the film thickness, i.e., the accuracy of determination on the decreasing gradient, increases toward the last phase of the life of the photoreceptor unit 7. Thus, high-accuracy life determination can be performed. Consequently, a great safe margin is not necessarily taken for setting the threshold of the degree of consumption of the film thickness for, e.g., the preannouncement message or forced stop, the degree of consumption being used at S77 of FIG. 14. As a result, the life of the photoreceptor unit 7 can be effectively used up without waste.

On the other hand, the decreasing gradient as the fixed value used before the rotation time R1 is typically a gradient taking a certain degree of safe margin into consideration. Thus, when life determination is, to the end, performed using the fixed value of the decreasing gradient, the photoreceptor unit 7 comes to the end of use with the potential life of the photoreceptor unit 7 remaining to some extent. In the present embodiment, the photoreceptor unit 7 can be used up to such an extent that the degree of consumption is increased by 20% as compared to the case of using the fixed value of the decreasing gradient to the end. Meanwhile, the fixed value is used in the beginning so that the amount of computation can be decreased and that a burden on a control system can be reduced.

Note that the above-described configuration is not intended to exclude use of the decreasing gradient based on actual measurement without using the fixed value in the beginning. Moreover, the technique can be employed, in which the fixed value is used only in first determination of the decreasing gradient and the decreasing gradient based on actual measurement is used after second determination. In other words, the condition for the timing of terminating use of the fixed value and the timing of switching the fixed value to the decreasing gradient based on actual measurement is not limited to the cumulative use amount of the photoreceptor unit 7 as described above. Such a condition may be optionally determined. For example, optional thresholds may be set for the current film thickness calculated at S75 or the consumption rate calculated at S76, and may be used as the switching condition.

Even with the measured charging current value, such a value is not used when the environment condition in measurement is not favorable (S63). This also contributes to improvement of the accuracy of life determination. Note that in the second embodiment, the developer 10 being configured as a replaceable development unit 10 is not a requirement. Moreover, an image formation device using other forms of charging members such as a charging blade instead of using the charging roller 8 may be provided.

According to the present embodiments described above in detail, the life of the photoreceptor unit 7 is determined using the charging current value measured in charging adjustment (the charging Vpp control). With this configuration, the life is, in association with progression in a decrease in the film thickness, managed separately and specifically for different individual photoreceptor units 7 and different contents of image formation. Thus, the image formation device 1 can be realized, which allows such life determination that the photoreceptor unit 7 is replaced after the potential life thereof has been effectively used up. In particular, weighting on the newly-calculated decreasing gradient in every charging adjustment and updating of the previous decreasing gradient realize both of a high life determination accuracy and prevention of excessive reflection of the measurement variation.

Although the present invention has been described and illustrated in detail, it is clearly understood that the same is by way of illustrated and example only and is not to be taken byway of limitation, the scope of the present invention being interpreted by terms of the appended claims. Thus, various modifications and changes can be, needless to say, made to the present invention without departing from the gist of the present invention. For example, the image formation device 1 described with reference to FIG. 1 etc. is of the tandem type, but the present invention is not limited to such an image formation device. The image formation device 1 may be of a multicycle type or a monochromatic type. The type of a developing solution of the developer 10 is not limited. Further, the image formation device 1 may has a reading function, a communication function, a double-sided function, and a post-processing function.

What is claimed is:

1. An image formation device including an image information process section having a photoreceptor configured to carry a toner image and a developer configured to form the toner image on a surface of the photoreceptor, the photoreceptor and the developer being configured as replaceable units, the image formation device comprising:

a development bias application section configured to apply a development bias to between the photoreceptor and the developer;

a stabilization control section configured to perform image stabilization control of determining a development bias value to be used in future by changing the development bias while measuring a density of the toner image formed by the developer, thereby obtaining the toner image with a target density;

a life determination section configured to determine expiration of use of at least one of the replaceable units of the image information process section when the development bias value determined by the stabilization control falls outside a preset acceptable range, and a photoreceptor use amount counting section configured to count a cumulative use amount of the photoreceptor, wherein the acceptable range used by the life determination section is set to shift downward in a case of a great cumulative use amount of the photoreceptor as compared to a case of a small cumulative use amount of the photoreceptor.

2. The image formation device according to claim 1, wherein the developer includes a plurality of developers, the developers are individual replaceable development units, and the acceptable range used by the life determination section is set for each development unit.

3. The image formation device according to claim 1, further comprising:

an environment condition storage section configured to store an environment condition when the image stabilization control is performed, wherein the life determination section is configured such that only a development bias value determined under a preset environment condition is available for determination.

4. The image formation device according to claim 1, further comprising:

a development use amount counting section configured to count a cumulative use amount of the developer, wherein the life determination section is configured not to perform determination until the cumulative use amount of the developer reaches a preset defined amount, to perform the determination after the cumulative use amount of the developer has reached the defined amount, and such that only the determined development bias value is available for the determination after the cumulative use amount of the developer has reached the defined amount.

5. The image formation device according to claim 1, wherein the photoreceptor is a photoreceptor unit replaceable independently of replacement of the developer.

6. The image formation device of claim 1, wherein the life determination section is configured to determine that a toner delivery capacity of the development roller is lowered when the development bias value determined by the stabilization control exceeds a preset upper limit value.

7. The image formation device of claim 1, wherein the life determination section is configured to determine that a toner charging amount increases when the development bias value determined by the stabilization control is less than a preset lower limit value.

8. The image formation device of claim 1, further comprising a stopping section configured to forcibly stop image formation when the life determination section determines that the development bias value determined by the stabilization control falls outside a preset acceptable range.

9. The image formation device of claim 1, further comprising a notifying section configured to notify a user of replacement of a developer when the life determination section determines that the development bias value determined by the stabilization control falls outside a preset acceptable range.

10. The image formation device of claim 9, wherein the notifying section is a display section and notifies a user by displaying a message.

11. The image formation device of claim 10, wherein the notifying section is a voice announcement.

12. The image formation device of claim 1, wherein the stabilization control section measures a density of the toner image formed by the developer at a plurality of different development bias values and determines from the plurality of different development bias values a determined development bias value that produces the toner image with a target density, the life determination section determines the expiration of use of the replaceable unit of the image formation process section when the determined development bias value falls outside a preset acceptable range.

* * * * *